US006319146B1

(12) United States Patent
Mills

(10) Patent No.: US 6,319,146 B1
(45) Date of Patent: Nov. 20, 2001

(54) GOLF PUTTER WITH ADJUSTABLE LIE AND OFFSET HOSEL

(76) Inventor: Truett P. Mills, 1310 Forrest Oaks La., Tuscaloosa, AL (US) 35406

( * ) Notice: Subject to any disclaimer, the term of this patent is extended or adjusted under 35 U.S.C. 154(b) by 0 days.

(21) Appl. No.: 09/368,976

(22) Filed: Aug. 5, 1999

Related U.S. Application Data

(60) Provisional application No. 60/139,331, filed on Jun. 14, 1999.

(51) Int. Cl.[7] ..... A63B 69/36; A63B 53/04

(52) U.S. Cl. ..... 473/244; 473/252; 473/305; 473/313; 473/340; 473/409

(58) Field of Search ..... 473/305, 306, 473/307, 313, 314, 340, 251, 225, 252, 253, 254, 286, 329, 350, 341, 244, 248, 324, 409; D21/736

(56) References Cited

U.S. PATENT DOCUMENTS

D. 216,031 * 11/1969 Blake .
D. 235,668 * 7/1975 Swash .
669,864 * 3/1901 Simpson .
1,291,967 * 1/1919 McDougal .
1,705,250 * 3/1929 Hincks .
3,539,184 * 11/1970 Koorland .
3,632,112 * 1/1972 Jacobs .
3,841,639 * 10/1974 Werner .
3,954,265 * 5/1976 Taylor .
3,967,826 * 7/1976 Judice .
4,508,342 * 4/1985 Drake .
4,650,191 * 3/1987 Mills .
4,815,739 * 3/1989 Donica .
4,819,943 * 4/1989 Szczepanski .
5,533,728 * 7/1996 Pehoski .
5,690,556 * 11/1997 Condon .
5,733,203 * 3/1998 Middleton .
5,749,791 * 5/1998 Passeri .
5,830,078 * 11/1998 McMahan .
6,001,028 * 12/1999 Tang .
6,004,222 * 12/1999 Moody .
6,080,070 * 6/2000 Whitley .

* cited by examiner

*Primary Examiner*—Sebastiano Passaniti
(74) *Attorney, Agent, or Firm*—Dority & Manning, PA

(57) ABSTRACT

A golf putter and method of making a putter is provided in which a front heel face of the putter defines a bore for receiving one end of a hosel, the hosel defining a substantially right angled bend. A free end of the hosel engages the putter shaft. The hosel provides a desired offset distance from the club strike face. Rotation of the hosel relative to the bore also provides an adjustment mechanism by which the lie angle and face balancing of the club may be achieved.

11 Claims, 9 Drawing Sheets

5
25
21
3
23
19
9
51
7
11
15

19'
51
17
13

GOLF PUTTER WITH ADJUSTABLE LIE AND OFFSET HOSEL

RELATED APPLICATIONS

This application claims the benefit of U.S. Provisional Application No. 60/139,331 filed Jun. 14, 1999.

FIELD OF THE INVENTION

This invention relates to a golf club and, more specifically, to improvements in a putter which enable a customized lie angle and an offset. Further, this invention relates to a method of assembling a putter having an adjustable lie angle and offset. Further, yet another aspect of this invention relates to improvements to a mallet-head putter providing a customized lie angle, offset, and other improvements for a putter or other golf club.

BACKGROUND OF THE INVENTION

A golfer's putting style and technique varies with every player having his or her own unique style. Traditionally, a golfer selects a putter that matches his or her own putting style. Further, golfers often require a putter that is customized to the physical attributes of the golfer. For instance, a golfer's putting posture, height, and length of arms, legs, and torso all have bearing on a golfer's putting style and selection of a preferred putter.

Further, for any given golfer, a golfer may desire a putter configuration to reflect the condition of a particular course. For instance, golf greens may vary in terms of the green speed based upon the turf grass used for the greens. Further, weather conditions and variations in course maintenance may further alter the characteristics of a green. Such characteristics may be reflected in a change to a golfer's style and preferred putter characteristics. Accordingly, there is a need for a putter that can be manufactured to the unique and varying demands of a particular golfer. Further, there is a need for a putter that can be customized to adapt to a given golfer's particular putting style.

There are a variety of putter-type golf clubs which provide for altering the lie angle between the shaft and the club head. One such example is in U.S. Pat. No. 5,577,726 to Fenton in which a hosel is set within a flange member in a pivotable fashion. A set screw locks the hosel within the flange member in a preselected position.

U.S. Pat. No. 5,462,279 to Culpepper discloses a reversible putter head which may be assembled to fit an individual golfer in accordance with a golfer's height, stature, and personal preference of the individual.

It is also known to provide a curved hosel which alters the position of the shaft relative to the club head. Such teachings are reflected in U.S. Pat. No. 5,720,672 to Smith.

U.S. Pat. No. 5,733,203 to Middleton teaches the use of a straight hosel positioned at 90 degrees relative to the axis of the shaft which may be used to provide an offset distance of the putter club head to the shaft which is greater than the diameter of a golf ball.

There remains room for variation and improvement in the art directed towards an improved putter which allows for a lie angle and offset to be individually set for a golfer. Moreover, there remains a need within the art for the customized improvement which is compatible with existing golf club heads such that existing putter heads can be adapted to allow for the lie angle and offset adjustments of the present invention. Further, the putter should be aesthetically pleasing and comfortable for the golfer to use.

SUMMARY OF THE INVENTION

An object of the present invention is to provide a golf club, including a putter, having an adjustable lie and offset which may be adjusted to permit customization by the club manufacturer to an individual golfer.

It is still another object of the present invention to provide a right-angled hosel extending from the heel of the front face of a putter.

It is yet another object of the present invention to provide an improved method for manufacturing a golf putter having a hosel which extends from the front heel face of a putter, the method being compatible with a flange putter head, a mallet putter head, or a solid, one piece putter head.

It is yet another object of the present invention to provide an improved putter having a shaft defining at least three angled bends, the respective bend angles being selected to provide the proper lie angle and offset for an individual golfer.

These and other objects of the invention are provided by a golf putter comprising a putter head, the putter head having a frontal ball striking face, a rear side, a toe, and a heel, the heel defining a bore therethrough extending from the ball striking face rearwardly. The putter head carries a hosel, the hosel including a first straight portion and a second straight portion, the second straight portion being angled with respect to the first portion and extending outwardly therefrom and generally perpendicular thereto. The first portion of the hosel is receivable in the bore defined by the putter head and secured therein to dispose the second portion of hosel in front of the striking face and at a distance less than the diameter of a ball to be struck thereby. The second portion of the hosel is at a predetermined angle with respect to an axis which may be perpendicular to or at an angle to the first portion of the hosel. The putter also has a shaft matable with the second portion of the hosel and extending outwardly therefrom, the putter head, hosel, and shaft cooperating to create a predetermined lie angle between the head and the shaft. Preferably, the L-shaped hosel forms a substantially right-angled bend between the first straight hosel end and the second straight hosel end. The lie and offset of the putter may be customized by the manufacturer by varying the distance the first straight end of the hosel extends from the heel of the putter face. The heel defines a threaded aperture in communication with the heel bore and with a screw, pin, or the like receivable in the threaded aperture to provide a hosel securing mechanism.

DETAILED DESCRIPTION OF PREFERRED EMBODIMENTS

Figure 1:
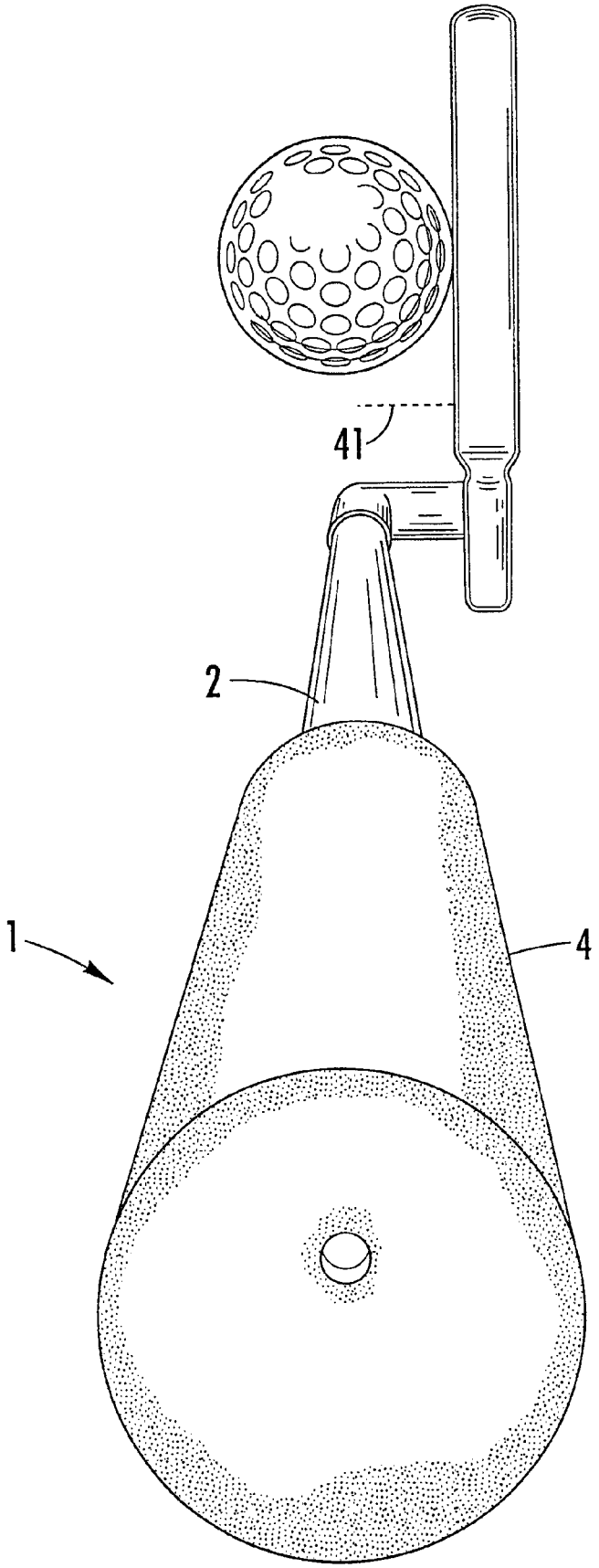
FIG. 1 is a top perspective view of a first embodiment of the invention.

Throughout the written description set forth below, the use of like numerals is used to indicate a similar structure in the same or different embodiments.

As seen in reference to FIGS. 1, and 2A–2D, a golf putter is provided having a shaft 2 with a grip 4 fixed to one end and a blade type putter head 3 fixed to the other. The putter head generally has a heel 5, a toe 7, a top 9, a sole 11, a rear side 13, and a face 15 which is used to strike a golf ball 51. The connecting end of shaft 2 is attached to the putter head 3 which is fixed to a hosel 21 which extends from the putter head.

Figure 3:
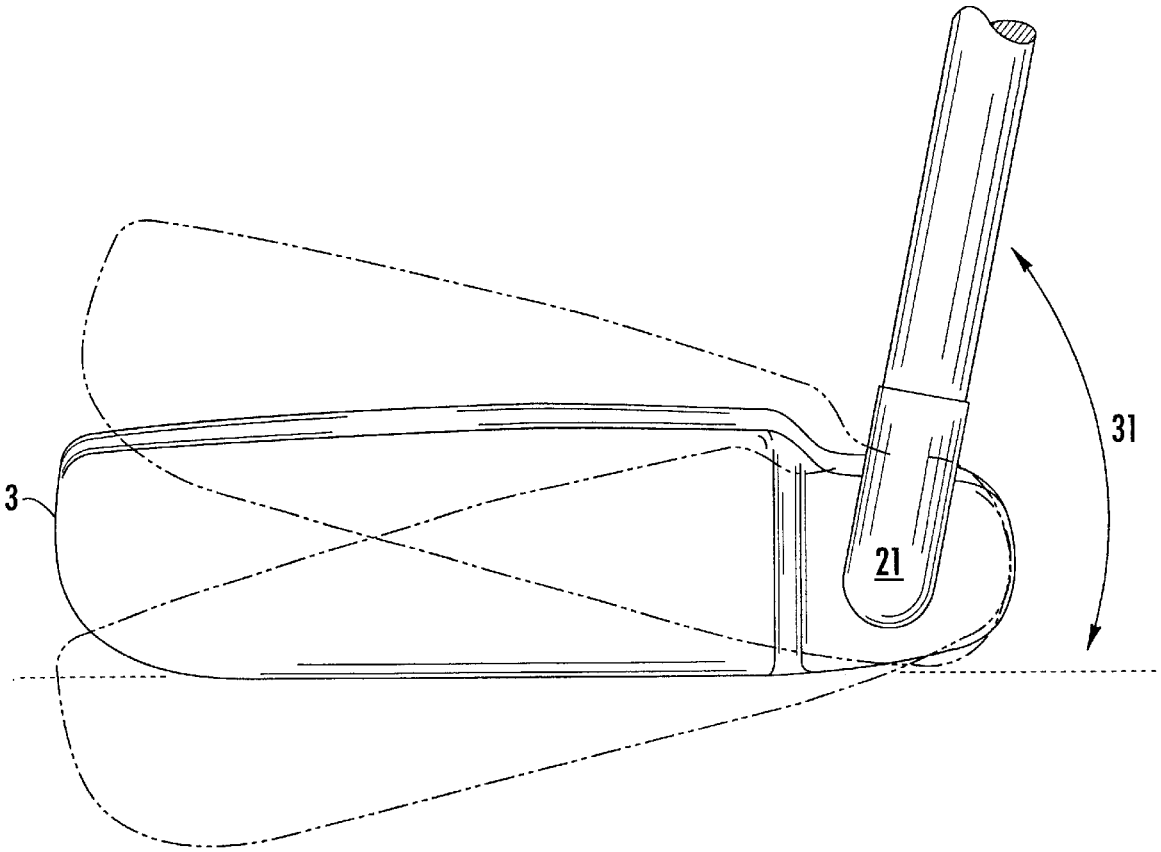
FIG. 3 is a front plan view of the putter head of the first embodiment and illustrating the adjustable features of the invention.

As used herein and in reference to the Figures, the term "lie angle" refers to the angle 31 between the horizontal and the longitudinal axis of the putter shaft as seen in FIG. 3. Positioning the correct lie angle for an individual ensures that the putter head is properly angled relative to the putting surface and ball during the putting stroke. A proper ball strike requires that the longitudinal axis of the putter head be properly angled relative to the putting surface. This positioning will better ensure that the face of the putter head strikes the ball in a proper position. If the lie angle is improperly positioned, there is a risk that the toe or the heel of the putter head will catch on the putting surface and cause misalignment of the putter face when the ball is struck.

As used herein, the term "offset" refers to the shortest horizontal distance between the longitudinal axis of the shaft and the lower edge of the putter head face as seen by reference numeral 41 in FIG. 1. The longitudinal axis of the putter shaft, if extended as an imaginary line, extends to a position in front of the face of the putter. This arrangement, known as a forward offset, places the shaft axis forward of the face of the putter. This placement is favored by many golfers in that the golfer's hands will be in front of the ball at the point of impact of the putting stroke. Many golfers believe this arrangement is preferred and that it provides an improved feel for the putt and increases accuracy of the putt since the club face may strike a ball above a center line of the ball, thereby providing topspin to the ball. The topspin helps the ball on a straight line and reduces the effects of surface irregularities on the putting green.

A forward offset is easier for most putters to visually align their putts. Further, a forward offset provides improved stability of the putter. A common putter head design has the putter head weight concentrated in the heel and toe of the putter. This design increases the moment of inertia of the putter head carried by the putter shaft. The offset provides yet a further increase in the moment of inertia by increasing the distance between the putter head mass and the shaft axis of rotation. The increase in the moment of inertia corresponds with an increase in the putter head's resistance to twisting when a golf ball is struck off-center from the putter face's "sweet spot". The twisting of the putter face is undesired in that the ball's direction of travel will vary from the intended putt direction.

Figure 2A:
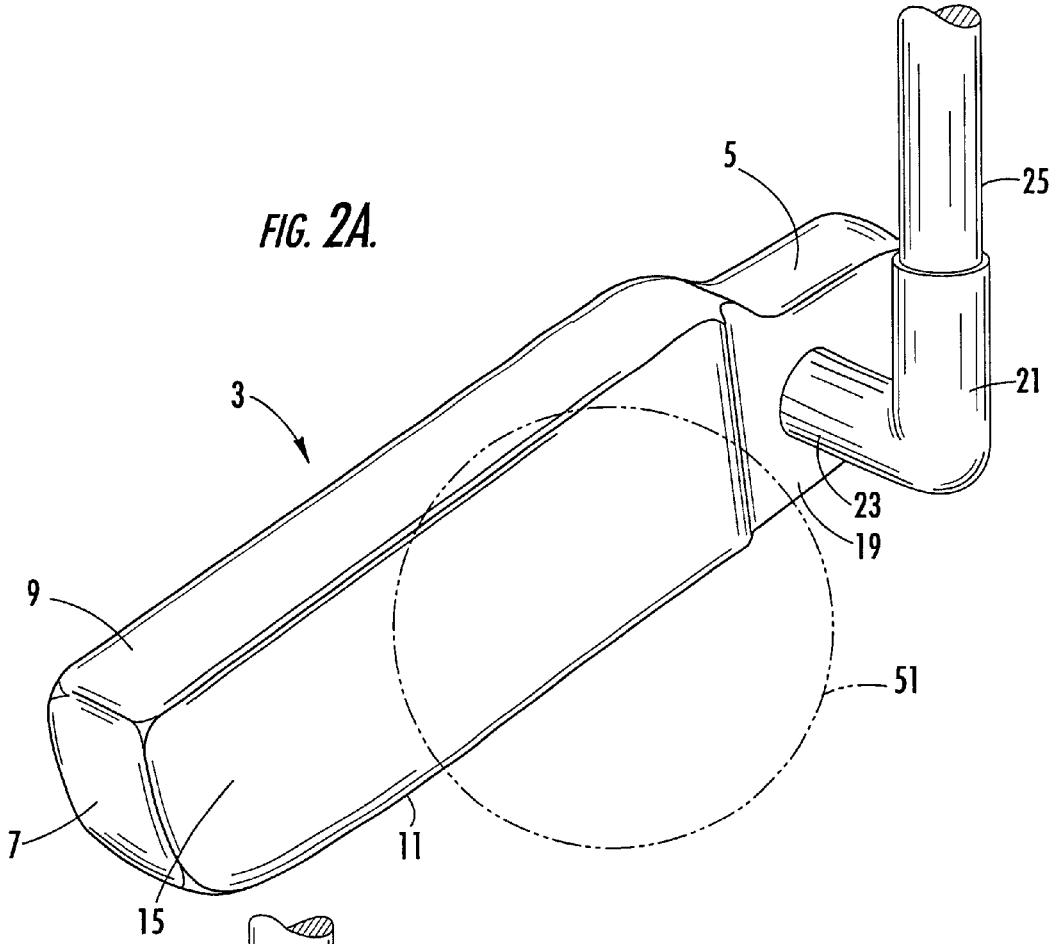
FIG. 2A is a front perspective view of the putter head of the first preferred embodiment.
Figure 2B:
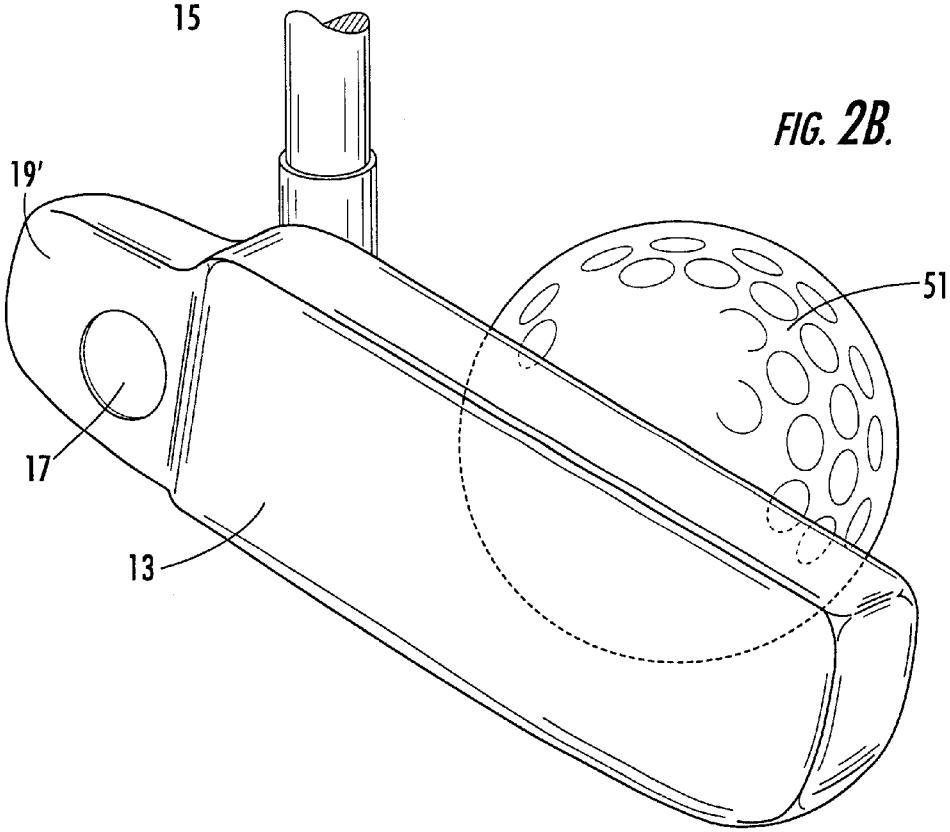
FIG. 2B is a rear perspective view of the putter head of the first preferred embodiment.

As best seen in reference to FIG. 2A, one embodiment of the putter head has a putter head 3 having a reduced height at the heel portion 5. Heel 5 defines a cylindrical bore 17 which traverses heel 5 from a front heel surface 19 to a rear heel surface 19'. As further seen in relation to FIGS. 2A and 2B, the front heel face 19 and rear heel face 19' are milled in such that the heel has a reduced width relative to the width of the non-heel portions of the putter head.

A substantially right angled hosel 21 is carried by the putter head and has a first portion 23 which is inserted into bore 17 of heel 3. While the first hosel portion is shown inserted perpendicular to the heel face, other orientations could be used. A second hosel portion 25 is adapted for receiving a hollow shaft, the second end 25 being curved to form a substantially right angle elbow.

Figure 2C:
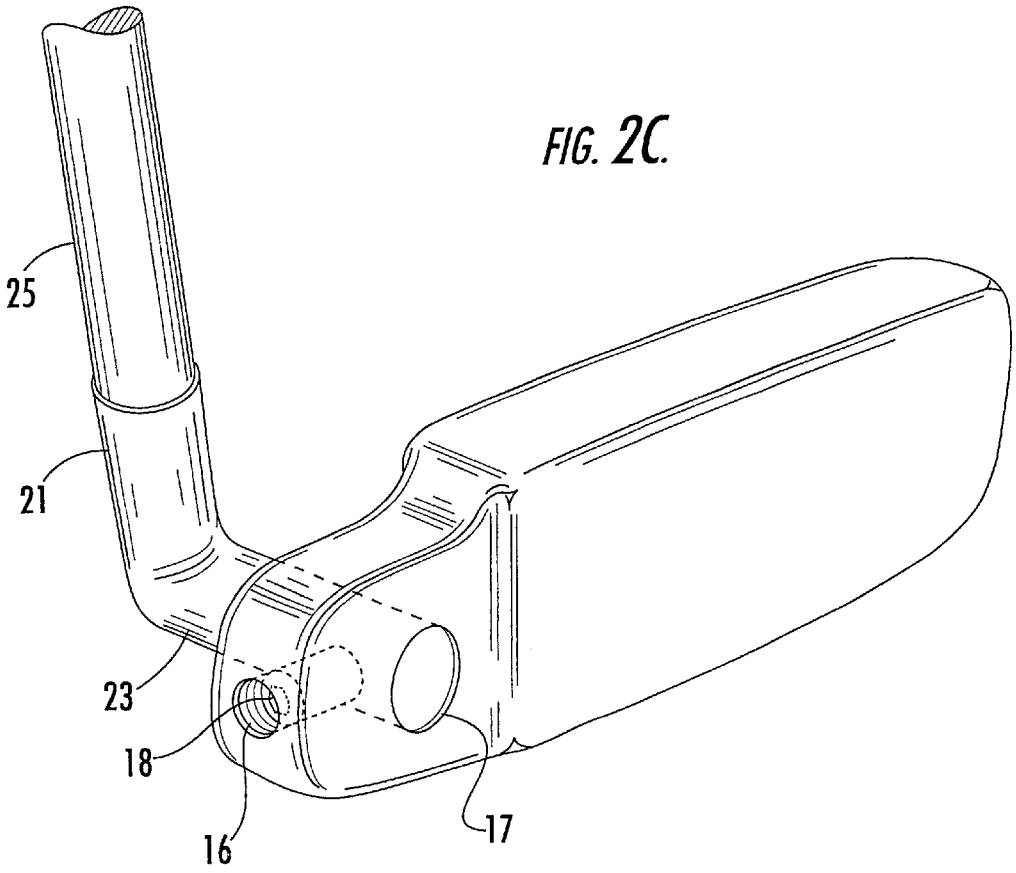
FIGS. 2C and 2D are perspective views of a first preferred embodiment showing additional details of the invention.
Figure 2D:
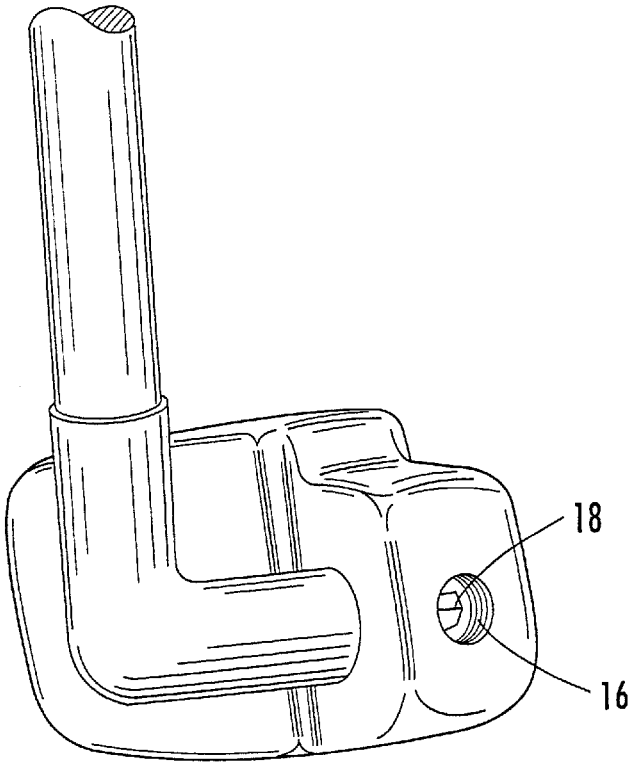

As seen in reference to FIGS. 2C and 2D, an aperture 16 is adapted for receiving a set screw, pin, or the like 18, aperture 16 and set screw or pin 18 positioned within heel 5 and in further communication with bore 17. The threaded set screw 18 can be used to secure first hosel end 23, thereby positioning the hosel relative to the club head. As seen in reference to FIG. 4A, the set screw and corresponding hole can be provided from the sole of the putter head or from any other location which operates to engage the set screw or pin 18 with the inserted length of the hosel.

Aesthetic determinations favor placement of the securing apertures and screws along the heel or sole of the putter head so as to provide a more finished appearance to the putter head. To conform to USGA rules, the aperture is filled with a thermoset adhesive or similar material which prevents the set screw and club head from being adjusted during play. It is envisioned that proper adjustments will normally be made at the time of manufacture or purchase.

As seen in reference to FIG. 3, the lie angle 31 may be adjusted by rotating the right angled hosel 21 relative to putter head 3.

Figure 4A:
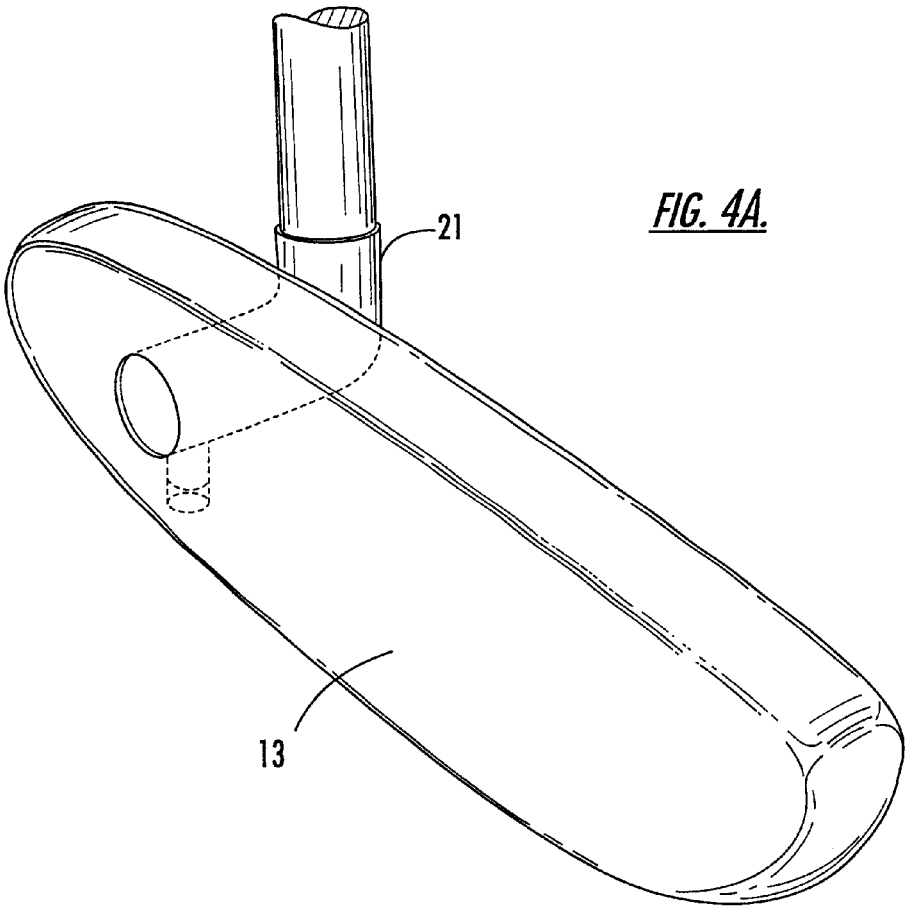
FIGS. 4A and 4B provide a second embodiment of the invention directed to a blade-type putter.
Figure 4B:
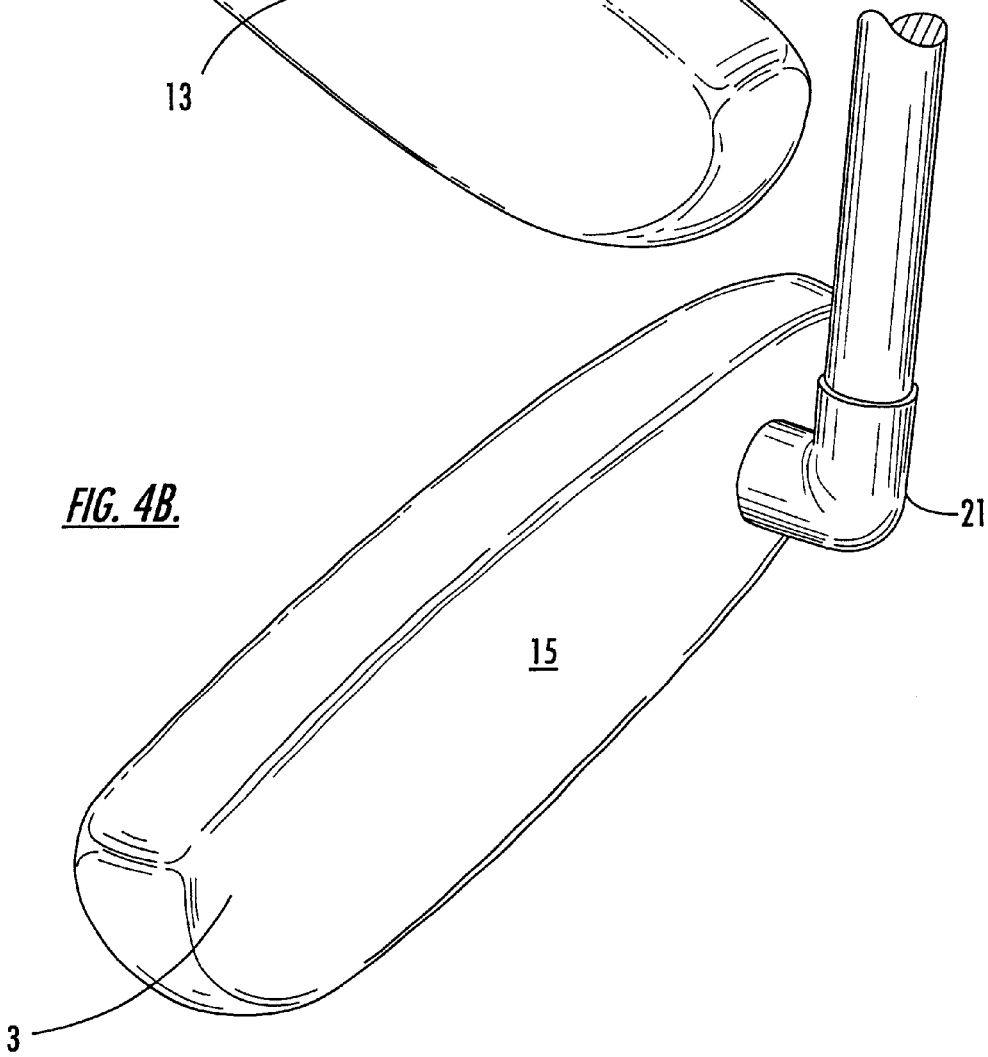
Figure 7A:
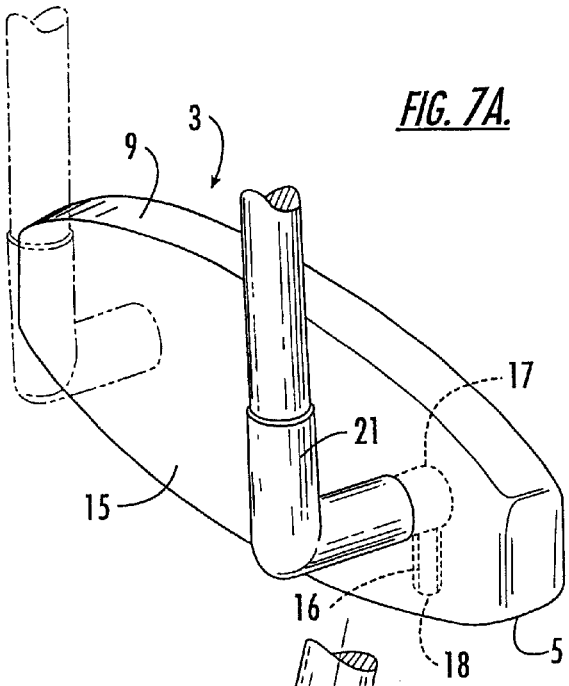
FIG. 7A is a fifth embodiment of the invention illustrating a symmetrical putter head constructed in accordance with this invention.

As seen in reference to FIGS. 4A and 4B, the right angled hosel may be used to engage a conventional solid putter head. As seen in FIG. 7A, a putter head lacking true symmetry between the top and the sole is provided. The asymmetrical putter head may be adapted for either a left or a right-handed golfer by varying the placement of the hosel along either end of the putter striking face.

Alternatively, if the hosel 21 is positioned along the true longitudinal center line of a putter head having identical top and sole features, a simple inversion of the putter head about the hosel will allow for different handedness for the same putter head.

As is common to all the examples above, the hosel 21 extends from the front face 15 of putter head 3. The placement of the hosel on the front face of the putter head and which extends less than the diameter of a golf ball, goes against the conventional teachings within the art. Conventional teachings suggest the use of a hosel extending from either the top or rear side of the putter.

Figure 7B:
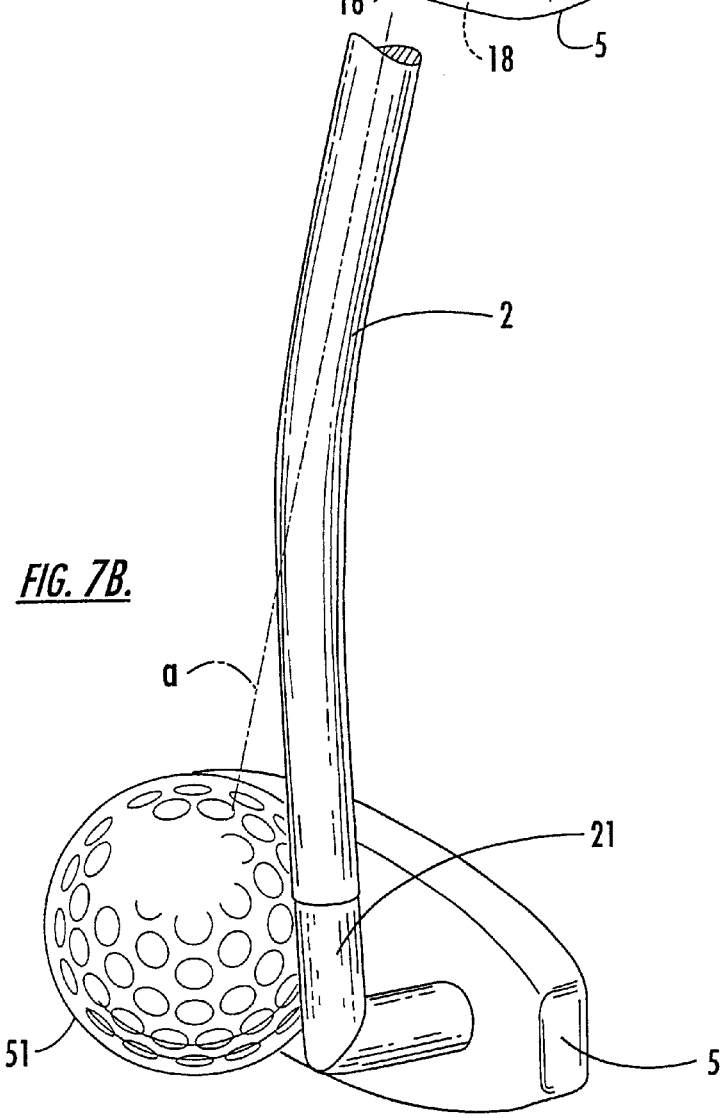
FIG. 7B is a perspective view of the putter head of FIG. 7A affixed to a single bend putter shaft, and illustrating a preferred lie angle defined by the shaft relative to the putter head and adjacent golf ball.

An additional feature, as seen in reference to FIG. 7B, illustrates the use of a bent angle shaft 2 which is useful with numerous embodiments of the present invention. The bent angled shaft allows the putter to be face balanced. A shaft may be bent at its lower end, in conformity to the rules of golf as defined by the United States Golf Association, such that the shaft bend locates the longitudinal axis of the shaft, defined by the straight portion of the shaft, so that the axis will pass through the center of gravity of the putter head (center shafted). By offsetting the shaft with the right angled hosel of the present invention, the variable offset provided by the variable length of hosel portion 23 will facilitate obtaining a face balance of the putter.

Further advantages are obtained by offsetting the shaft axis "a" (FIG. 7B) forwardly of the center of gravity of the putter head. This positioning serves to add to the moment of inertia of the putter head about the rotational axis of the shaft. This, of course, further increases the moment of inertia in comparison to a face balance center shafted putter which has its axis of rotation passing through the center of gravity.

Figure 6:
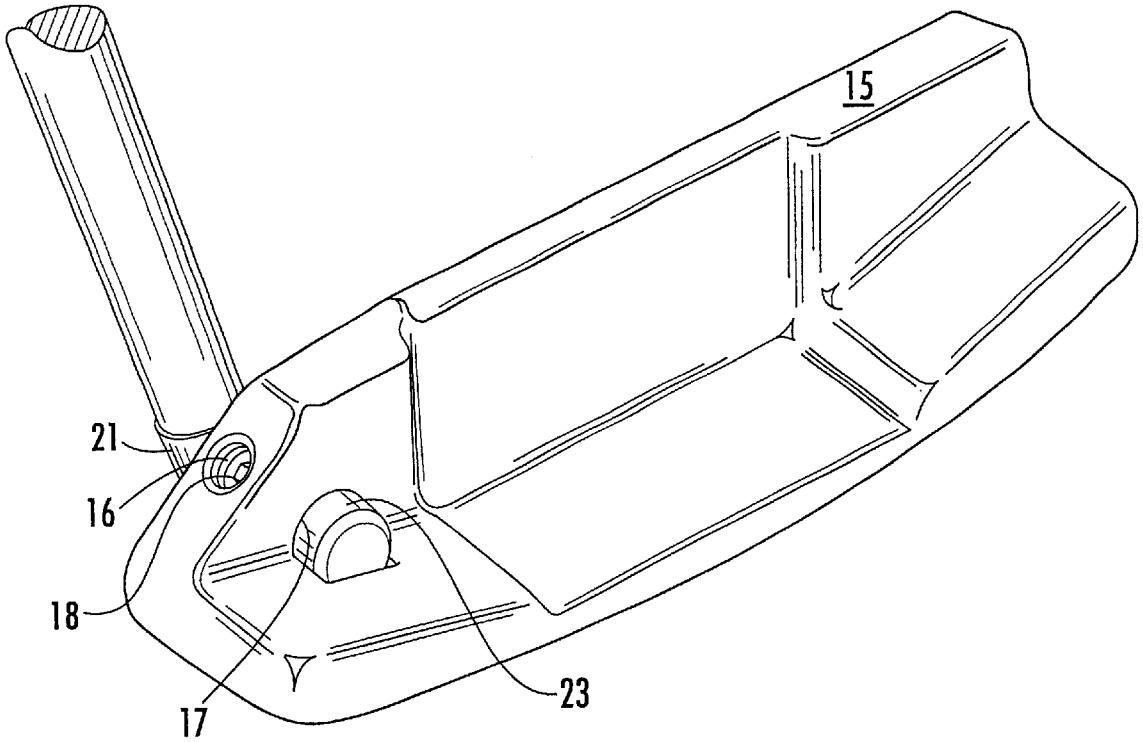
FIG. 6 is a fourth embodiment of the invention directed to a retrofitted blade-type putter which has been modified in accordance with this invention.

An additional embodiment is seen in reference to FIG. 6 where a blade type putter, typically having an original integral hosel (not shown), may be adapted for use with the present invention. As illustrated in FIG. 6, following removal of the original hosel, a threaded aperture 16 with threaded set screw 18 is used to intersect the right angled hosel 21 as inserted through a retrofitted bore 17. A lower portion of hosel end 23 rests beneath a plane defined by a rear flange of the putter head. Thereafter, a new bore 17 is provided along with an intersecting threaded bore 16. Threaded set screw 18 can thereafter be used to secure hosel 21 and the accompanying shaft so as to provide an adjustable lie angle.

The embodiment seen in reference to FIG. 6 illustrates that existing putter heads may be easily retrofitted in accordance with the present invention. As illustrated, even putter heads with an integral hosel can have the original hosel portion removed. Further, no loss of performance characteristics have been noted during the evaluation of the retrofitted blade putting heads. Rather, performance is improved by the reduced tendency of the putter head to rotate when a ball is hit off-center. Further, a manufacturer can customize a desired lie angle for the resulting putter much more easily. In so doing, the lie angle and offset adjustments make use of minimal parts which are fully compatible with any conventional putter head and club.

Figure 8:
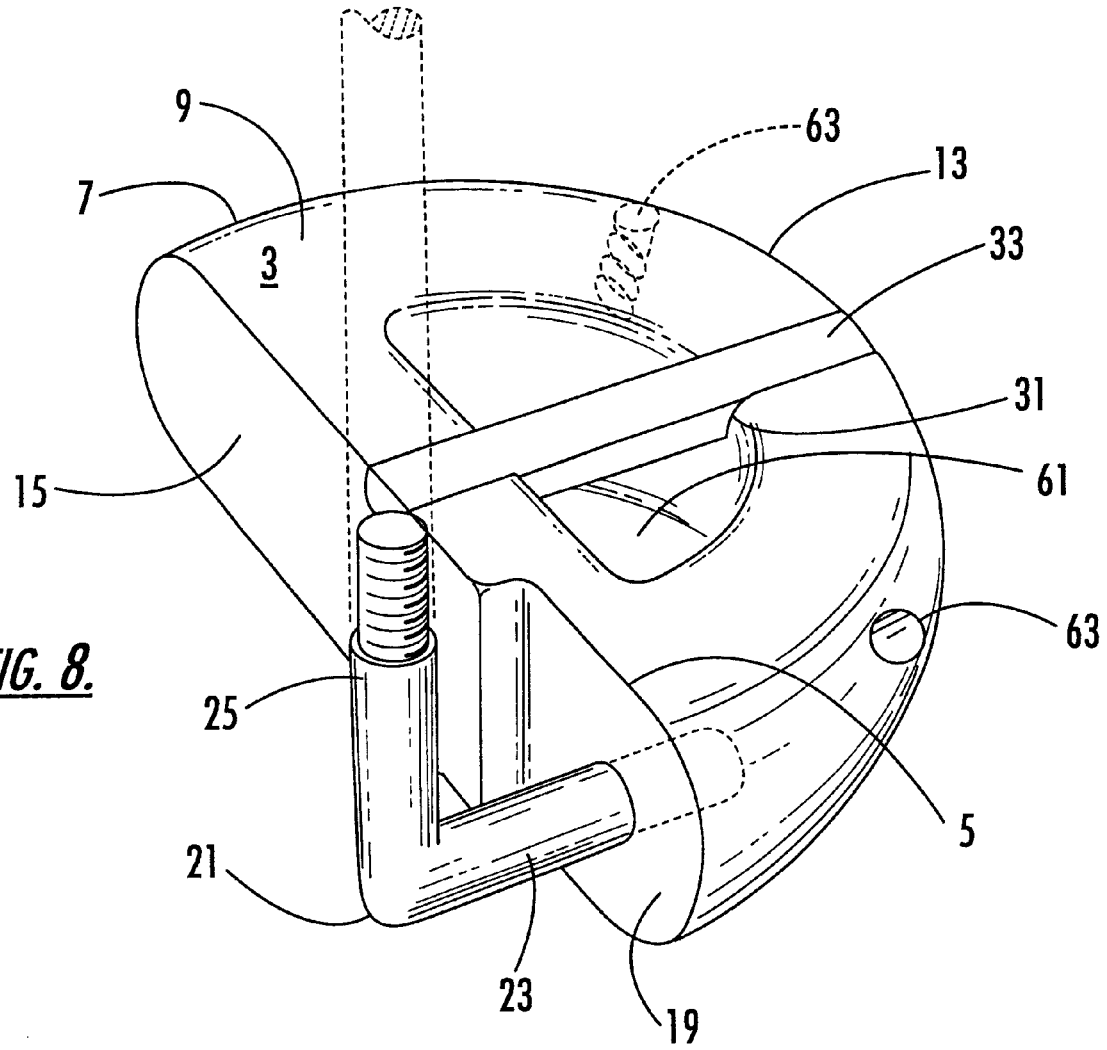
FIG. 8 is a perspective view of a mallet head putter in accordance with the present invention.

Yet another embodiment of the present invention is seen in reference to FIG. 8 which sets forth a putter head 3 seen in the form of a mallet head and in accordance with the present invention. The mallet putter head may define a central opening 61, the opening increasing the percentage of weight distributed in the rear of the putter head. If desired, weighted inserts 63 may be attached into defined receptacles along the rear of the putter head.

The putting head has a semi-circular profile providing a flat putting face 15. The toe 7, rear side 13, and heel 5 define an outer arcuate surface. Preferably, the shape of the opening 61 conforms generally to the shape of the club head. In the illustrated embodiment, the opening 61 is centered within the club head so that the outer rim of the club head has a substantially uniform thickness. However, it is envisioned that the opening 61 may be positioned closer to the club face, thereby providing a substantially greater thickness to the rear club head rim. The positioning, size, and shape of the opening 61 may be used to advantage in providing a club which has a desired face balancing property. Further, opening 61 shifts a greater proportion of the club head mass to the rear of the club head, thereby helping the club head to resist rotation about the shaft axis when a ball is struck.

An L-shaped, substantially right-angled hosel 21 may be attached to a heel face 5, the heel face defining an optional notched portion 31 along the rear heel of the putter head. Hosel 21 is carried through a bore 17 defined within the heel face to which a first end 23 of the hosel is inserted. A second hosel end 25 is adapted for receiving the shaft of the putter, the second hosel end 25 positioned at a right angle to first hosel end 23 by an "L"-shaped interconnecting elbow.

While not shown in the illustrated embodiment, the securement of the hosel to the putter head may make use of similar set screws, apertures, and bores as described in reference to embodiments set forth above.

An alignment guide 33 is also provided as seen in the form of a metal bar positioned flush along a groove 31 defined by the top surface of the putter head and which runs the width of the putter head from the face 15 to the rear 13. The alignment bar's position provides a visual indicator of the "sweet spot" of the putter head and helps in the alignment of the golfer's putt. This embodiment maintains the advantages associated with a mallet-type putter head design such as the increased mass in the rear of the putter head. The combination of the offset hosel and alignment guide provides a putter which is face balanced and permits an unobstructed view of the alignment guide throughout the putting stroke. The central opening 61 allows a putter to see the putting surface beneath the club head. The cavity helps a putter center and align the club head with respect to the ball. The addition of the alignment guide 33 provides an additional visual aid to assist with the alignment of the club head to the ball.

Figure 5:
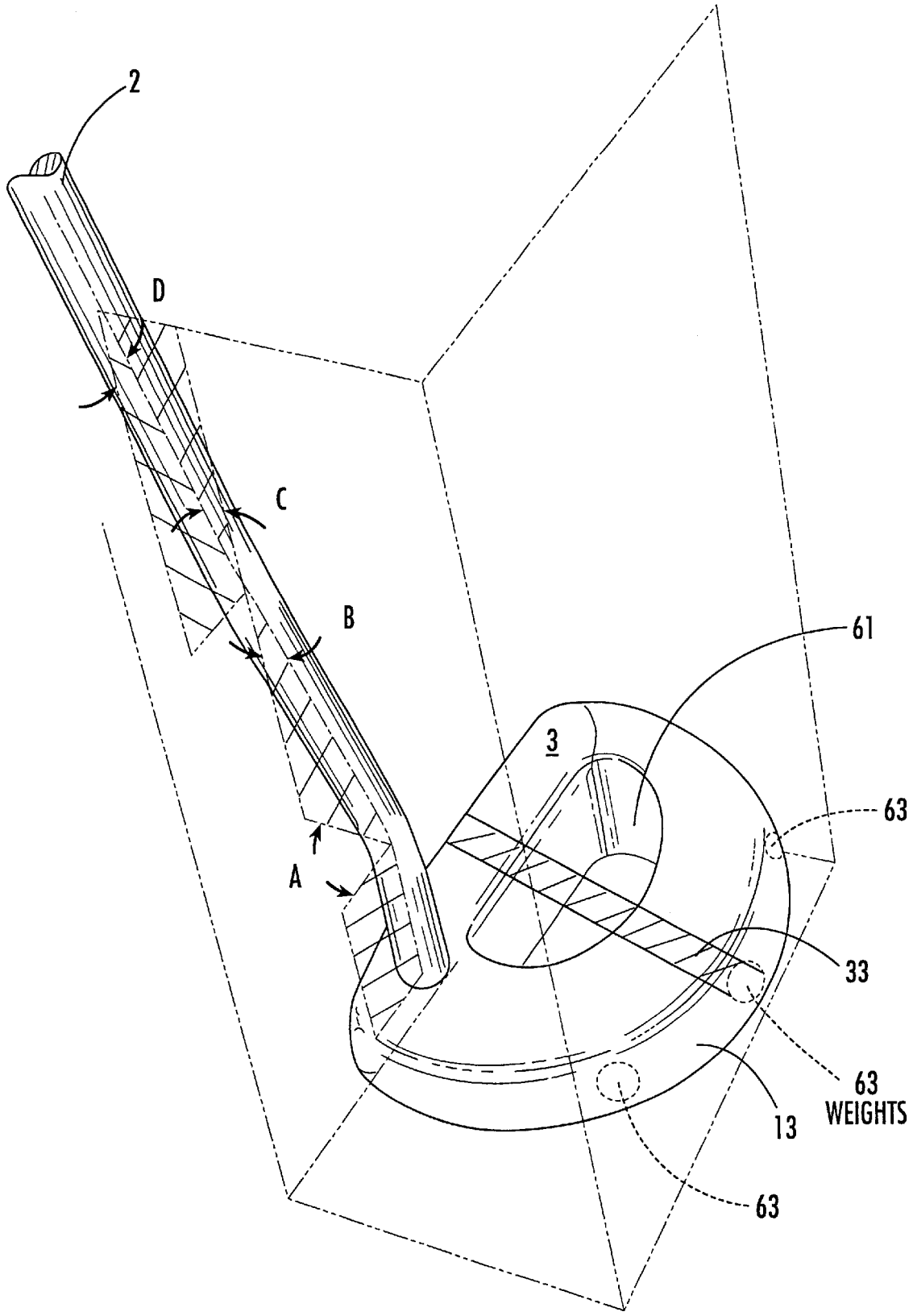
FIG. 5 is a third embodiment of a putter in accordance with the present invention.

As seen in reference to FIG. 5, a triple bend shaft can also be used in conjunction with the mallet head putter to provide an offset shaft in a face balanced configuration which also permits an unobstructed view of the alignment guide. The shaft angles and bends A–D are selected to provide a customized offset, lie angle, and face balance for the resulting putter. In this embodiment, the shaft attaches to a hosel which extends from the top of the club head.

In the preferred embodiments which make use of a hosel extending from the heel face of a putter head, the first hosel end 23 may be of any desired length. In fact, it is found useful to have the length of portion 23 greater than the finished installed length. Once installed to an individual's specifications, the terminus of portion 23 may be trimmed flush with the rear heel face of the putter. This arrangement facilitates the adjustment of the degree of offset of the resulting putter. If a greater offset is desired, the hosel may be extended relative to the face of the putter, thereby providing a greater offset distance. Correspondingly, the hosel can be inserted further into bore 17, thereby providing a putter having a reduced offset.

The use of a right-angled hosel extending from the front face of the putter, as described in certain embodiments set forth above, has been found to offer certain advantages. One such advantage is the ease in which the lie angle can be customized. Further, the right-angled hosel and its afforded advantages may be use in combination with any conventional putter head design.

Surprisingly, the preferred embodiments which provide for a right-angled hosel extending from the heel of the putting face does not interfere with the golfer's alignment of the ball. Even a shanked putt will tend to travel true.

The present invention also provides advantages for the manufacturer or retailer of the putter. The present invention permits the lie angle, offset, and face balancing of a putter to be adjusted to a variety of settings to meet the needs of a broad range of golfers. These adjustments can be done with virtually any putter head and shaft. Therefore, with a minimal number of basic components, a full range of putters having varying characteristics can be provided.

While the present invention has been described in reference to putters, the right angled hosel may be used with other club heads including woods, irons, wedges. Similarly, the triple bend shaft described in reference to one of the embodiments, may also be used on a variety of different type clubs.

Although certain embodiments of the invention have been described using specific terms, materials, and methods, such description is for illustrative purposes only. The words used are words of description rather than of limitation. It is to be understood that changes and variations may be made by those of ordinary skill in the art without departing from the spirit and scope of the present invention which is set forth in the following claims. In addition, it should be understood that aspects of the various embodiments may be interchanged, both in whole or in part.

What is claimed is:

1. A golf putter comprising:

a putter head, said putter head having a frontal ball striking face, a rear side, a toe, and a heel, said putter head defining a notch in a forward face of said heel, said heel face defining a bore therethrough extending from said forward face rearwardly;

a hosel, said hosel including a first straight portion and a second straight portion, said second portion being angled with respect to said first portion and extending outwardly therefrom, said first portion of said hosel being partially receivable in said bore defined by said putter head and secured therein to dispose said second portion of said hosel in front of said striking face and at a predetermined angle with respect to an axis perpendicular to said first portion of said hosel; and a shaft matable with said second portion of said hosel and extending outwardly therefrom, said putter head, hosel, and shaft cooperating to create a predetermined lie angle between said head and said shaft.

2. A golf club comprising:

a club head having a face portion for striking a golf ball, and a heel, said heel having a reduced width in relation to a width of said face portion;

an L-shaped hosel having a first straight end in communication with a bore defined by a front face of said heel of said club head and a second straight end attached to a receiving end of a club shaft, said first straight end extending in front of said face a distance less than the diameter of a ball to be struck thereby.

3. The golf club according to claim 2 wherein said L-shaped hosel forms a substantially right-angled bend between said first straight end and said second straight end.

4. The golf club according to claim 2 wherein the offset distance of the club is adjusted by varying the distance of the first straight end of said hosel extending from the heel of the club head face.

5. The putter according to claim 2 wherein said heel defines a threaded aperture carrying a screw, said threaded aperture in further communication with said heel bore.

6. A golf putter comprising:

a club head member of a semi-circular shape having a round portion and a flat portion, the flat portion further defining a shaped side member comprising a ball striking surface, said club head defining an opening between the sole of the club head and the top of the club head said club head defining a notch in a forward face of a heel;

an alignment notch defined by an upper surface of said putter head, the alignment notch extending from the flat portion to a rear of the head member;

an insert positioned within the alignment notch to provide a reference for the user of a putter head; and, a shaft matable to a hosel carried by the head member.

7. The putter according to claim 6 wherein said shaft is a triple bend shaft attached to a hosel extending from a top surface of the club head, at least one bend of the shaft establishing a lie angle between the shaft and the club head.

8. The putter according to claim 6 wherein the notch defined in the forward face of the heel defines a bore therethrough extending rearwardly from the heel face;

a hosel, said hosel including a first straight portion and a second straight portion, said second portion being angled with respect to said first portion and extending outwardly therefrom and generally perpendicular thereto, said first portion of said hosel being partially receivable in said bore defined by said putter head and secured therein to dispose said second portion of said hosel in front of said striking face and at a distance less than the diameter of a ball to be struck thereby and a predetermined angle with respect to an axis perpendicular to said first portion of said hosel; and the shaft matable with said second portion of said hosel and extending outwardly therefrom, said putter head, hosel, and shaft cooperating to create a predetermined lie angle between said head and said shaft.

9. The putter according to claim 6, wherein the club head defines an opening having a semi-circular shape.

10. A method of manufacturing a putter comprising:

supplying a putter head having a frontal ball striking face, a rear side, a toe, and a heel, said heel having a thickness less than a thickness of the putter head adjacent the frontal ball striking face;

providing a bore within the heel, the bore extending from a front surface of the head;

providing a hosel, the hosel including a first straight portion and a second straight portion, the second straight portion being angled with respect to the first portion and extending outwardly therefrom and generally perpendicular thereto;

inserting the first portion of the hosel into the bore defined by the putter head;

securing the hosel with the bore wherein a second portion of the hosel extends in front of the striking face and at a distance less than the diameter of a ball to be struck thereby and a predetermined angle with respect to an axis perpendicular to the first portion of the hosel; and installing a shaft matable with the second portion of the hosel and extending outwardly therefrom, the putter head, hosel, and shaft cooperating to create a predetermined lie angle between the head and the shaft.

11. The method according to claim 10 wherein the putter head is a flange putter head.

* * * * *